United States Patent [19]

Soloveychik et al.

[11] Patent Number: 4,653,942

[45] Date of Patent: Mar. 31, 1987

[54] METHOD AND APPARATUS FOR PRINTING BRAILLE

[75] Inventors: Yakov G. Soloveychik, Granada Hills; John J. Messerly, Culver City, both of Calif.

[73] Assignee: Visualtek, Inc., Calif.

[21] Appl. No.: 896,298

[22] Filed: Aug. 12, 1986

Related U.S. Application Data

[63] Continuation of Ser. No. 701,026, Feb. 12, 1985, abandoned.

[51] Int. Cl.[4] ..... B41J 3/32

[52] U.S. Cl. ..... 400/122; 400/692

[58] Field of Search ..... 400/18, 19, 118, 121, 400/122, 124, 144.2, 483, 692; 434/113, 114, 115

[56] References Cited

U.S. PATENT DOCUMENTS

| | | | |
|---|---|---|---|
| 1,293,023 | 2/1919 | Bryan et al. | 434/115 X |
| 2,039,406 | 5/1936 | Greensfelder | 400/122 X |
| 3,880,269 | 4/1975 | Carbonneau | 400/122 |
| 4,047,606 | 9/1977 | Ott | 400/124 |
| 4,444,519 | 4/1984 | Howell et al. | 400/144.2 X |

FOREIGN PATENT DOCUMENTS

| | | | |
|---|---|---|---|
| 62067 | 4/1983 | Japan | 400/124 |
| 177292 | 3/1922 | United Kingdom | 400/122 |

OTHER PUBLICATIONS

IBM Technical Disclosure Bulletin, vol. 11, No. 12, May 1969, p. 1649, "Random Braille Printer" by Loeber.

*Primary Examiner*—Charles A. Pearson

*Attorney, Agent, or Firm*—Kelly, Bauersfeld & Lowry

[57] ABSTRACT

A conventional serial computer printer is modified by removing the roller platen, solenoid plunger and daisy wheel. A punch guide in the form of an elongated plate having openings corresponding to at least some of the embossment positions in a line of Braille together with a back-up die in the form of an elongated plate having indentations each defining the shape of a Braille character embossment in alignment with the openings in the punch guide are substituted for the platen roller in the printer. A Braille medium upon which a line of Braille is to be printed is receivable between the punch guide and back-up die. A flexible punch is substituted for the normal plunger in the solenoid so that the Braille characters can be successively punched by the punch passing through selected ones of the openings to thereby provide a line of Braille.

1 Claim, 4 Drawing Figures

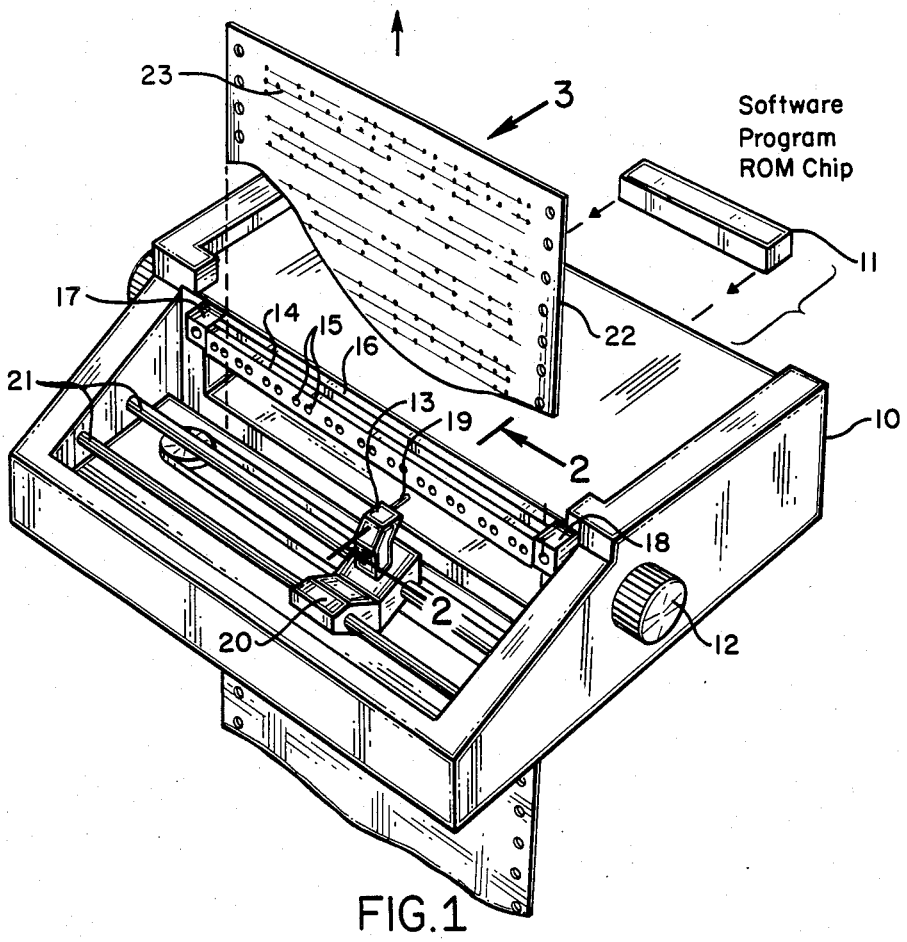
FIG. 1
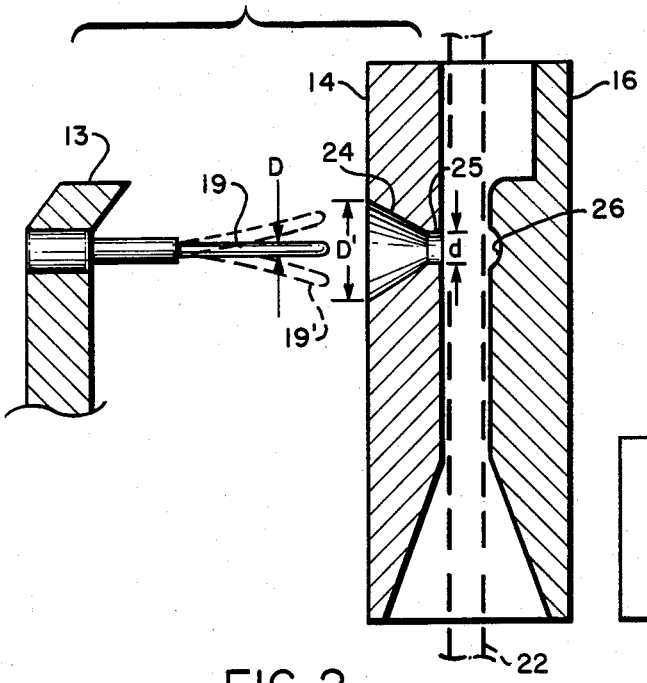
FIG. 2
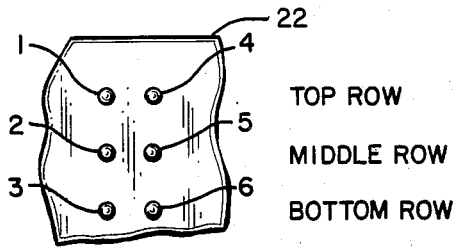
FIG. 3
| | |
|---|---|
| TOP ROW | ALL 4's AND 1's |
| MIDDLE ROW | ALL 2's AND 5's |
| BOTTOM ROW | ALL 6's AND 3's |
FIG. 4

METHOD AND APPARATUS FOR PRINTING BRAILLE

This application is a continuation of application Ser. No. 701,026 filed Feb. 12, 1985, now abandoned.

FIELD OF THE INVENTION

This invention relates to an improved method and apparatus for printing Braille wherein a conventional serial computer printer is modified.

BACKGROUND OF THE INVENTION

A Braille character for reading by the blind normally constitutes at least one embossment in at least one position of a six-position matrix made up of two vertical columns of three positions each and top, middle and bottom horizontal rows of two positions each. Different characters will have different numbers of embossments in various selected ones of the six possible positions in the matrix.

A conventional Braille printer usually comprises a die plate having indentations positioned in accord with the six-position matrix of a Braille character. A Braille medium such as relatively thick paper is positioned beneath this die and on the other side of the Braille medium there are provided six pins also in the six positions of the Braille matrix character. Certain ones of these pins are caused to be raised upon a flat surface in accord with a particular Braille character to be reproduced. When the particular pins have been raised the die plate is brought down pressing or sandwiching the Braille medium between the die plate and the selected pins thereby generating embossments on the Braille medium.

After one Braille character has been printed, the entire embossment mechanism is moved to the next position for the next Braille character and so forth. The medium is then indexed upwardly a distance of one row of Braille characters in the manner of a sheet of paper in a conventional typewriter.

Braille printers of the foregoing type are relatively expensive to produce. The situation is further aggrevated by the fact that there is relatively little demand for a Braille printer or at least, a limited demand. Therefore, it does not become economically feasible to try to mass produce such Braille printers as by utilizing assembly line techniques.

BRIEF DESCRIPTION OF THE PRESENT INVENTION

With the foregoing considerations in mind, the present invention contemplates a method and apparatus for printing Braille which can be far more economically carried out than is possible by the manufacture of conventional Braille printers.

More particularly, in accord with the present invention a conventional serial computer printer operable by a software program is modified by removing the roller platen and solenoid operated plunger and cooperating daisy wheel. A punch guide in the form of an elongated plate having a series of horizontally aligned openings grouped in pairs together with a back-up die also constituting an elongated plate provided with indentations defining the shape of a Braille character embossment in alignment with the punch guide openings are substituted for the roller platen in the serial computer printer. Also, a flexible punch is substituted for the normal plunger and daisy wheel configuration in the printer.

A Braille medium is arranged to be received between the punch guide and back-up die. The printer is then operated with a modified software program to cause Braille characters to be printed out successively by the punching action of a solenoid and punch when the solenoid and punch traverse in a horizontal direction between the ends of the punch guide.

With respect to the foregoing, the openings in the punch guide constitute an important feature of the invention in that they will index the punch each time the punch is actuated by the solenoid to effect formation of a Braille embossment on the medium.

BRIEF DESCRIPTION OF THE DRAWINGS

A better understanding of this invention will be had by now referring to the accompanying drawings, in which:

FIG. 1 is a broken away perspective view of a modified serial printer for printing a line of Braille in accord with the present invention;

FIG. 2 is a greatly enlarged cross section of a portion of the printer of FIG. 1 looking in the direction of the arrows 2—2;

FIG. 3 is a fragmentary view of the Braille medium of FIG. 1 looking in the direction of the arrow 3; and, FIG. 4 is a simple table helpful in illustrating the operation of the printer of FIG. 1.

DETAILED DESCRIPTION OF THE PREFERRED EMBODIMENT

Referring first to FIG. 1, there is shown a conventional serial computer printer 10 operable by a software program schematically depicted by a ROM chip 11. Computer printer 10 has been modified in accordance with the method and apparatus of this invention by removing the conventional roller platen which would serve to index paper upwardly as by platen knob shown at 12.

The conventional solenoid 13 which would normally cause a plunger to move back and forth against a daisy wheel is shown in FIG. 1. However, the plunger and daisy wheel have been removed and a flexible punch has been substituted for the plunger.

Substituted for the roller platen is a punch guide in the form of an elongated plate 14 having at least one series of horizontally aligned openings grouped in pairs such as indicated at 15. A back-up die in the form of another elongated plate 16 is shown parallel to the punch guide 14. As will become clearer as the description proceeds, the back-up die plate 16 has indentations defining the shape of a Braille character embossment in alignment with the openings 15 of the punch guide.

The punch guide 14 and back-up die 16 are secured in fixed position in the typewriter by brackets 17 and 18 at the opposite ends of the assembly as shown.

The flexible punch held within the conventional solenoid 13 is shown at 19 in FIG. 1 and will move in a horizontal direction between the opposite ends of the guide 14. Towards this end, the conventional carriage for moving the solenoid is shown at 20. It will be appreciated that in the original serial printer prior to modification, a software program would cause the carriage 22 to traverse along guide rails 21 moving left to right and right to left, the original plunger being actuated by the solenoid to impress against a character in the daisy wheel to print information on paper normally held in the conventional roller platen.

In the modified printer of FIG. 1, a Braille medium 22 which is comprised of somewhat thicker paper than normal typing paper is fed up between the punch guide 14 and back-up die 16 as indicated in FIG. 1. This Braille medium 22 as shown is of the tractor feed type and is fed up from the bottom. Because of its thickness, it is not feasible to have the same roll around a platen-type roller. The Braille medium 22 has been broken away in order to avoid obscuring the back-up die 16.

In FIG. 1 there is depicted on the Braille medium 22 a line of Braille 23. Each character in this line is comprised of at least one embossment in at least one position of a six-position matrix made up of two vertical columns of three positions each and top, middle and bottom horizontal rows of two positions each all as described briefly heretofore.

A modified software program is utilized in place of a conventional software program found in the ROM chip 11 to operate the computer printer in such a manner that the Braille characters to be printed are successively punched by action of the solenoid 13 and punch 19 while traversing in a horizontal direction between the ends of the punch guide. In this respect, the punch 19 will be successively received in selected ones of the openings 15 of the punch guide to thereby form an embossment on the medium 22, this embossment being defined by the corresponding indentation on the back-up die 16.

The foregoing will be better understood by referring to the enlarged cross section of FIG. 2 wherein it will be noted that the punch 19 is flexible; that is, the same can flex slightly as indicated by the phantom lines 19'. The diameter of the punch has a given value D as shown.

A typical opening on the punch guide 14 has an enlarged entrance opening of a diameter D', larger than said given diameter D. This entrance opening tapers down in diameter as indicated at 24 in FIG. 2 to a value slightly greater than said given diameter as indicated by the letter d at 25.

With the foregoing arrangement, should the punch 19 not be in exact axial alignment with the opening, it will be guided by the taper portion 24 into precise alignment and thence pass through the exit portion 25 of the opening into the corresponding indentation 26 thereby forming an embossment on the medium shown in phantom lines at 22. This action of the tapered surface on the punch 19 will center the same within the opening to its precise horizontal position so that there are eliminated cumulative errors in the traversing of the carriage from one end of the punch guide to the other.

It will be understood that the openings in each pair of openings 15 in the punch guide are spaced in accord with the horizontal spacing between embossments in a Braille character and the spacing between successive pairs of openings will correspond to the spacing between successive Braille characters in the line 23.

FIG. 3 shows a fragmentary portion of the medium 22 with a character of Braille wherein all six positions constitute an embossment. The embossments in the vertical rows are designated 1, 2 and 3 and 4,5 and 6 respectively. The embossments in the top row, middle row and bottom row are designated 1, 4; 2, 5; and 3,6 respectively.

When a modified software program is provided, the punch 19 of FIG. 1 and cooperating solenoid 13 will generate the desired embossments, the punch being received in selected ones of the openings 15 on the punch guide 14 depending upon the program. Thus, in generating or printing a line of Braille, with the particular embodiment illustrated wherein there is provided a single punch, the following steps are taken:

First, embossments are punched on the Braille medium 22 one at a time progressing in one horizontal direction at those positions along the top rows of all characters in the line in which embossments are to be provided.

Next, the Braille medium is indexed up one row by the normal indexing usually operated to index tractor feed paper as shown in FIG. 1.

Third, embossments are punched on the medium one at a time progressing in a direction opposite to the one direction at those positions along the middle rows of all characters in the line in which embossments are to be provided.

Fourth, the Braille medium 22 is indexed up another row.

Fifth, embossments are punched on the medium one at a time progressing in the one horizontal direction at those positions along the bottom rows of all characters in the line in which embossments are to be provided.

The foregoing steps are schematically depicted in the table of FIG. 4. Thus, when the carriage moves along a first horizontal direction, all the 4's and 1's are printed to make up the top row. Then the carriage will return after indexing of the medium upwardly and all of the 2's and 5's will be printed. Then the carriage will again move to print the bottom row wherein all the 6's and 3's are printed.

It should be understood that whie a single punch 19 and solenoid 13 have been shown, it is possible in accord with the invention to provide more than one punch. For example, three vertically aligned punches could be provided with associated solenoids. The punch guide 14 would then include additional pairs of openings to define the three rows making up a Braille character and the back-up die 16 would be similarly provided with indentations. An entire line of Braille could then be printed with only one pass of the carriage from one end of the guide plate to the other. Other modifications falling clearly within the scope and spirit of this invention will occur to those skilled in the art.

Because the Braille printer is provided in accord with the method and apparatus of this invention by the simple modification of a readily available conventional serial computer printer, the Braille printers as described can be produced relatively ecconomically. A typical serial computer printer Model F 10-55 is available at this time (1985) from the distributor C. ITOH 19750 South Vermont Ave. Ste. 220, Torrance, Calif. 90502 USA for Tokyo Electric Co. Ltd.

We claim:

1. A method of printing a line of Braille constituting the modification of a conventional serial computer printer wherein said printer normally includes a roller platen and a solenoidoperated plunger and cooperating daisy wheel, said modification including the steps of:

(a) removing said roller platen and inserting a punch guide and back-up die in fixed positions, the punch guide constituting an elongated plate having at least one series of horizontally aligned openings grouped in pairs, the openings in each pair being spaced in accord with the horizontal spacing between embossments in a Braille character and the back-up die constituting an elongated plate having identations defining the shape of a Braille character embossment in alignment with said openings in said punch guide, a Braille medium upon which said line of Braille is to be printed being receivable between said punch guide and back-up die;

(b) removing said plunger and cooperating daisy wheel and inserting at least one flexible punch for operation by said solenoid such that said punch can be successively moved into and out of said openings when aligned therewith and actuated by said solenoid; and (c) operating said computer printer wherein the Braille characters to be printed are successively punched by action of said solenoid and punch when traversing in horizontal directions between the ends of the punch guide.

* * * * *